US006066913A

United States Patent [19]

Choi et al.

[11] Patent Number: 6,066,913

[45] Date of Patent: May 23, 2000

[54] METHOD OF ARRANGING A CONDUCTIVE WIRE PATTERN OF A FILM-TYPE SADDLE DEFLECTION MEMBER FOR A CRT

[75] Inventors: Baek Young Choi; Soo Kyong Byun; Don Bean Choi, all of Kyungsnagbuk, Rep. of Korea

[73] Assignee: Orion Electric Company, Kyungsangbuk-do, Rep. of Korea

[21] Appl. No.: 09/091,786

[22] PCT Filed: Dec. 30, 1996

[86] PCT No.: PCT/KR96/00274

§ 371 Date: Jun. 24, 1998

§ 102(e) Date: Jun. 24, 1998

[87] PCT Pub. No.: WO98/19326

PCT Pub. Date: May 7, 1998

[51] Int. Cl.[7] ..... H01J 29/70

[52] U.S. Cl. ..... 313/440; 313/441; 335/210; 335/213

[58] Field of Search ..... 313/364, 421, 313/440, 441, 442, 443; 335/210, 211, 212, 213, 214; 348/380, 805–809

[56] References Cited

U.S. PATENT DOCUMENTS 3,792,305 2/1974 Lister ..... 315/22 X
4,126,842 11/1978 Barouh et al. ..... 335/213
4,556,857 12/1985 Logan ..... 335/210
5,847,503 12/1998 Roussel et al. ..... 313/440

*Primary Examiner*—Vip Patel
*Assistant Examiner*—Matthew J Gerike
*Attorney, Agent, or Firm*—Notaro & Michalos P.C.

[57] ABSTRACT

Disclosed is a method of arranging a conductive wire pattern of a film-type saddle deflection member for a cathode ray tube which properly arranges the conductive wires of each film such that an optimum magnetic field can be obtained, and a film-type saddle deflection member having the conductive wire pattern arranged by the method. In the method, the total number of conductive wires arranged from a horizontal axis of the cathode ray tube to a position having an angle of θ is determined by a following equation according to angle θ taken from the horizontal axis of the cathode ray rube: $[\Phi(\theta)=A_1 \sin \theta+A_3 \sin 3\theta+A_5 \sin 5\theta+ \ldots]$, in which θ is an angle taken from the horizontal axis to 90 degree, $A_1, A_3, A_5, \ldots, A_{2N-1}$ are integers, and n is a natural number. The method converts a curved line of a predetermined magnetic field patten into a Fourier series and arranges the conductive wires of each film based on the Fourier series, thereby producing the magnetic field pattern designed to be nearly perfect.

9 Claims, 7 Drawing Sheets

METHOD OF ARRANGING A CONDUCTIVE WIRE PATTERN OF A FILM-TYPE SADDLE DEFLECTION MEMBER FOR A CRT

FIELD OF THE INVENTION

The present invention generally relates to a method of arranging a conductive wire pattern of a film-type saddle deflection member for a cathode ray tube and a film-type saddle deflection member having the conductive wire pattern arranged by the method. More particularly, the present invention relates to a method of arranging a conductive wire pattern of a film-type saddle deflection member for a cathode ray tube which properly arranges a plurality of conductive wires in each film such that an optimum magnetic field can be obtained, and relates to a film-type saddle deflection member having the conductive wire pattern arranged by the method. In the present invention, each pair of film-type deflection members is formed, in stead of winding coils, by stacking a plurality of films such as flexible printed circuit boards having at least one conductive wire arranged in a predetermined pattern one on another, or by stacking conductive wire layers having a plurality of conductive wires arranged in a predetermined pattern with interposing an insulation layer between upper and lower portions of the conductive wire layers, in such a manner that the film-type deflection members can produce a predetermined magnetic field pattern.

BACKGROUND OF THE INVENTION

FIG. 1 shows a color-picture cathode ray tube 10 including a panel 12 having a panel surface 18, a fluorescence screen 20 formed on the back of the panel surface 18, a neck 14 containing an electron gun 11 which produces electron beams 19*a* and 19*b* and emits them towards the fluorescence screen 20, a funnel 13 for connecting the neck 14 to the panel 12, and a deflection yoke assembly 17 mounted on a connection portion at which the neck 14 is connected to the funnel 13.

The funnel 13 has an internal conductive layer (not shown) contacting a positive electrode terminal 15. A shadow mask 16, which has a plurality of apertures or slots 16*a* arranged in a predetermined pattern, is spaced at a predetermined distance apart from the screen 20 and is detachably installed in the panel 12.

The deflection yoke assembly 17 generally has a pair of horizontal deflection members and a pair of vertical deflections members. As a current is applied thereto, the horizontal deflection members produce a horizontal deflection magnetic-field for horizontally deflecting the electron beams 19*a* and 19*b*. In addition, the vertical deflection members also produce a vertical deflection magnetic-field for vertically deflecting the electron beams 19*a* and 19*b* as a current is applied to the vertical deflection members.

The deflection magnetic-fields is preferably varied by a proper means in such a manner that the electron beams 19*a* and 19*b* can be scanned over the whole face of the fluorescence screen 20, thereby providing two-dimensional images having an optimum deflection sensitivity on the cathode ray tube 12. In addition, such deflection of the magnetic field permits the horizontal deflection member to produce a pincushion magnetic field, and permits the vertical deflection member to produce a barrel magnetic field so that the electron beams of an in-line type electron gun are easily converged.

FIG. 2 is a sectional view taken along line 2—2 of FIG. 1 for illustrating a pair of film-type saddle horizontal deflection members LF and RF and a pair of film-type toroidal vertical deflection members UF and LR. The saddle horizontal deflection members LF and RF are mounted on the yoke with a supporting member 135*a* being interposed between the saddle horizontal deflection members LF and RF and an inner surface of a bobbin 135, and the toroidal vertical deflection members UF and LR are wound around a core 36 at the outside of the bobbin 135.

FIG. 3 shows European patent application No. 85201158.4 (Publication No. E.P. 0 1169 613 A1) filed by Philips Electronic and Associated Ind. Ltd., at al., which discloses a saddle horizontal deflection member 30 mounted as mentioned above. As shown in FIG. 3, the saddle horizontal deflection member 30 for the cathode ray tube comprises a deflection film 31 and a connection film 35 electrically connected to the deflection film 31 so as to form a predetermined circuit. The center portion of the deflection film 31 is severed by a predetermined width, and a neck end turn portion 34 is provided at the connection portion thereof. A plurality of conductive wires disposed in both severed sides of the deflection film 31 respectively form deflection portions 32 and 33. Connection portions 32' and 33', at which each conductive wire is exposed, are formed at both ends of deflection portions 32 and 33. The connection film 35 forming a U-shaped bridging member of the deflection film 31 is provided with connection portions 35' and 35', at the ends of which the plural conductive wires are exposed, thereby connecting the connection portions 32' and 33' of the deflection film 31 such that they form a predetermined circuit.

FIG. 4 schematically shows one film of a film-type saddle deflection member as proposed by the same inventors and assigned to the assignee of present invention. As shown in FIG. 4, the film-type saddle deflection member comprises a plurality of deflection films F1(FN) and connection films C1(CN). The deflection films F1(FN) are respectively formed at the center thereof with a window so that it can be easily located at a predetermined position, and a plurality of conductive wires for producing a deflection magnetic field are arranged in a predetermined pattern at each deflection portion FR and FL. The conductive wires are connected to each other at a neck end turn portion FE. In addition, connection portions F1R . . . FNL, which are exposed to the outside so as to form connection terminals, are provided at each end of the conductive wires so that the connection portions F1R . . . FNL are connected to the connection portions C1R . . . CNL of connection films C1(CN), thereby forming a predetermined circuit.

The film-type saddle deflection member constructed as mentioned above can be simply manufactured as compared with the prior saddle deflection coil in which coils are wound around a core. Further, the pattern structure of the conductive wires in the film-type saddle deflection member constructed as mentioned above is not only evenly and stably formed, but also variously changed. However, though it can variously change the pattern structure, the film-type saddle deflection member constructed as mentioned above should have been tested many times in order to obtain the optimum pattern structure.

SUMMARY OF THE INVENTION

The present invention has been made to overcome the above described problem, and accordingly, it is an object of the present invention to provide a method of arranging a conductive wire pattern of a film-type saddle deflection member for a cathode ray tube which properly arranges the conductive wires in each film such that a predetermined magnetic field having the optimum deflection sensitivity and convergence can be obtained, and to provide a film-type saddle deflection member having the conductive wire pattern arranged by the method.

In order to attain the above object, there are provided a method of arranging a conductive wire pattern of a film-type saddle deflection member for a cathode ray tube and a film-type saddle deflection member having the conductive wire pattern arranged by the method, in which the film-type saddle deflection member comprises a plurality of deflection films F1(FN) and a plurality of connection films C1(CN), the plurality of deflection films (F1(FN) are stacked one on another and formed in a predetermined shape, the plurality of deflection films (F1(FN) has a pair of deflection portions, a neck end turn portion, and a pair of first connection portions, and the plurality of connection films has a pair of second connection portions and connects the pair of first connection portions of the deflection films to each other at the pair of the second connection portions thereof, thereby forming a funnel end turn portion, being characterized in that the total number of conductive wires arranged from a horizontal axis of the cathode ray tube to a position having an angle of θ is determined by a following equation according to angle θ from the horizontal axis of the cathode ray tube: $[\Phi(\theta)=A_1 \sin \theta+A_3 \sin 3\theta+A_5 \sin 5\theta+\ldots]$, wherein 74 is an angle taken from the horizontal axis to 90 degree, $A_1, A_3, A_5, \ldots, A_{2N-1}$ are integers, and n is a natural number.

BRIEF DESCRIPTION OF THE ATTACHED DRAWINGS

DETAILED DESCRIPTION OF PREFERRED EMBODIMENTS

Hereinafter, the preferred embodiment of the present invention will be described with reference to the attached drawings.

Figure 1:
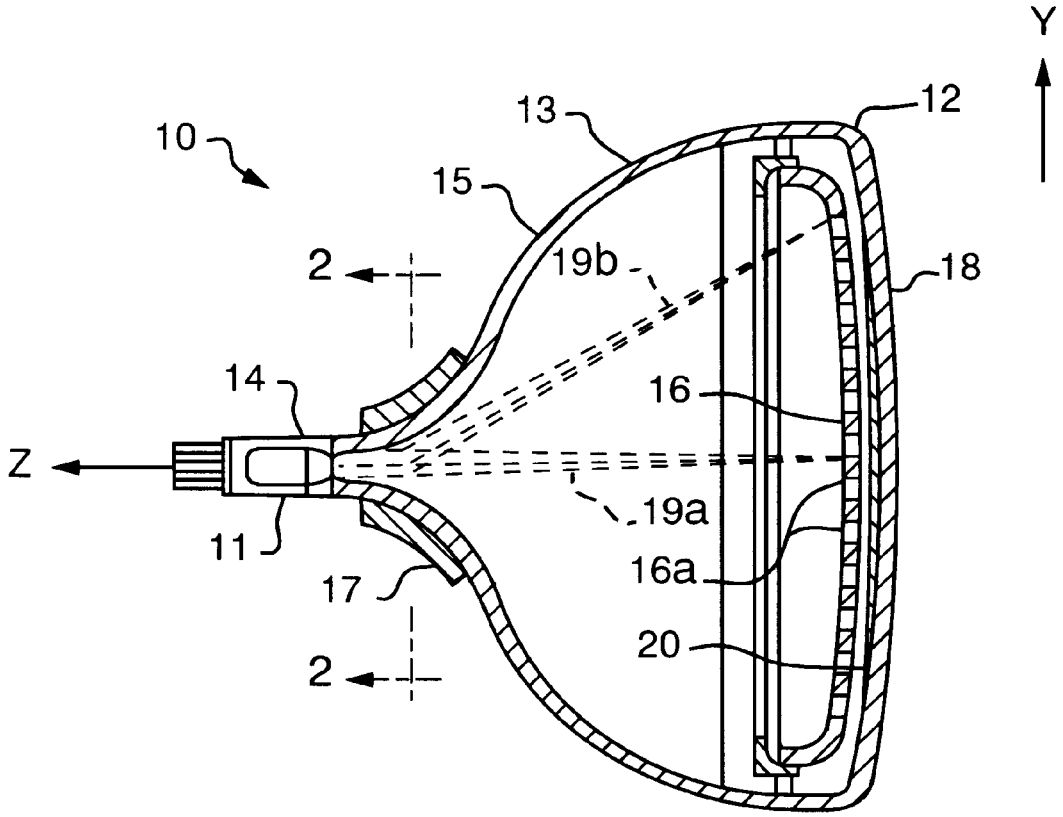
FIG. 1 is a longitudinally and partially sectional plan view for schematically illustrating the structure of a color-picture cathode ray tube.
Figure 2:
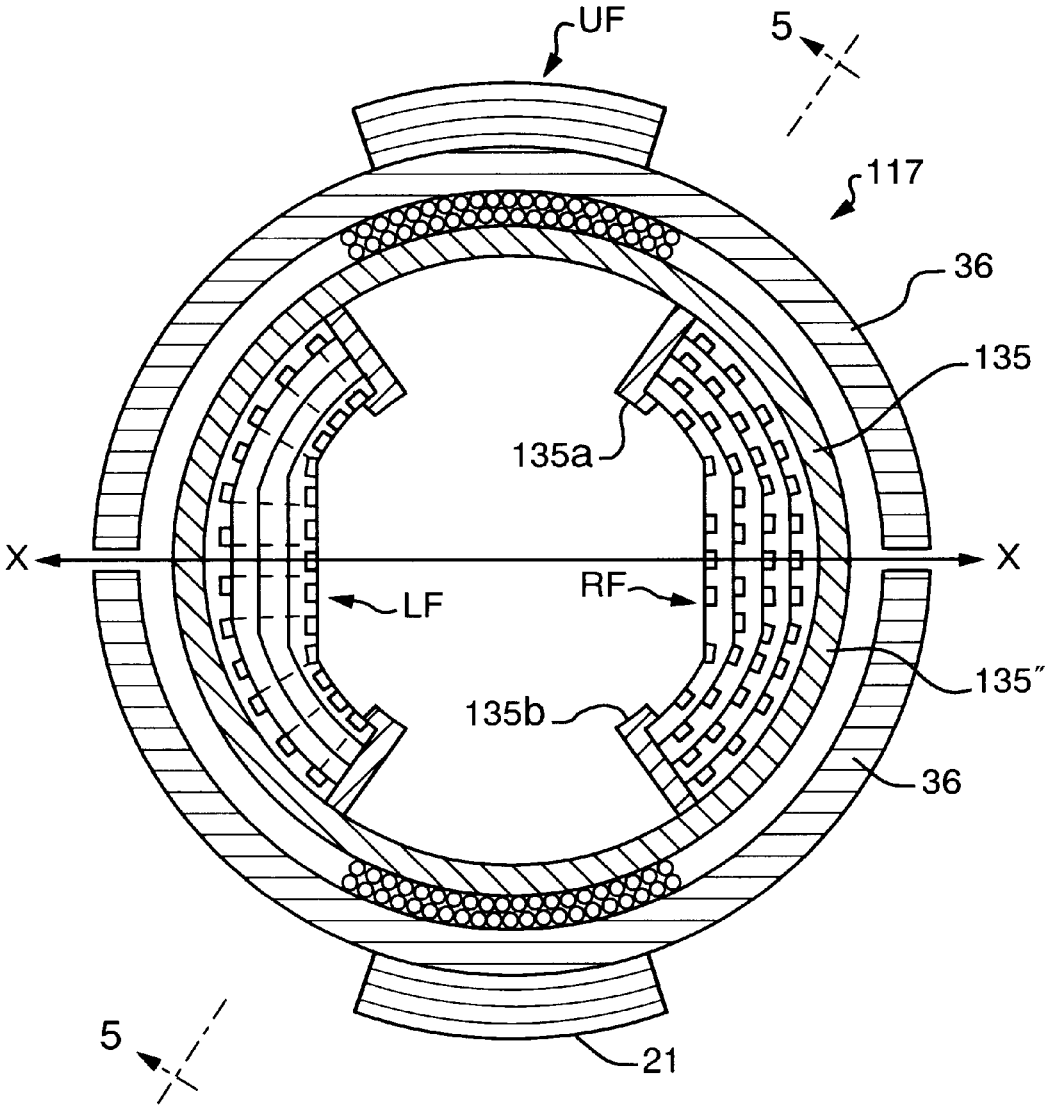
FIG. 2 is a sectional view taken along line 2—2 of FIG. 1 for illustrating a pair of saddle horizontal deflection members and a pair of toroidal vertical deflection members.
Figure 3:
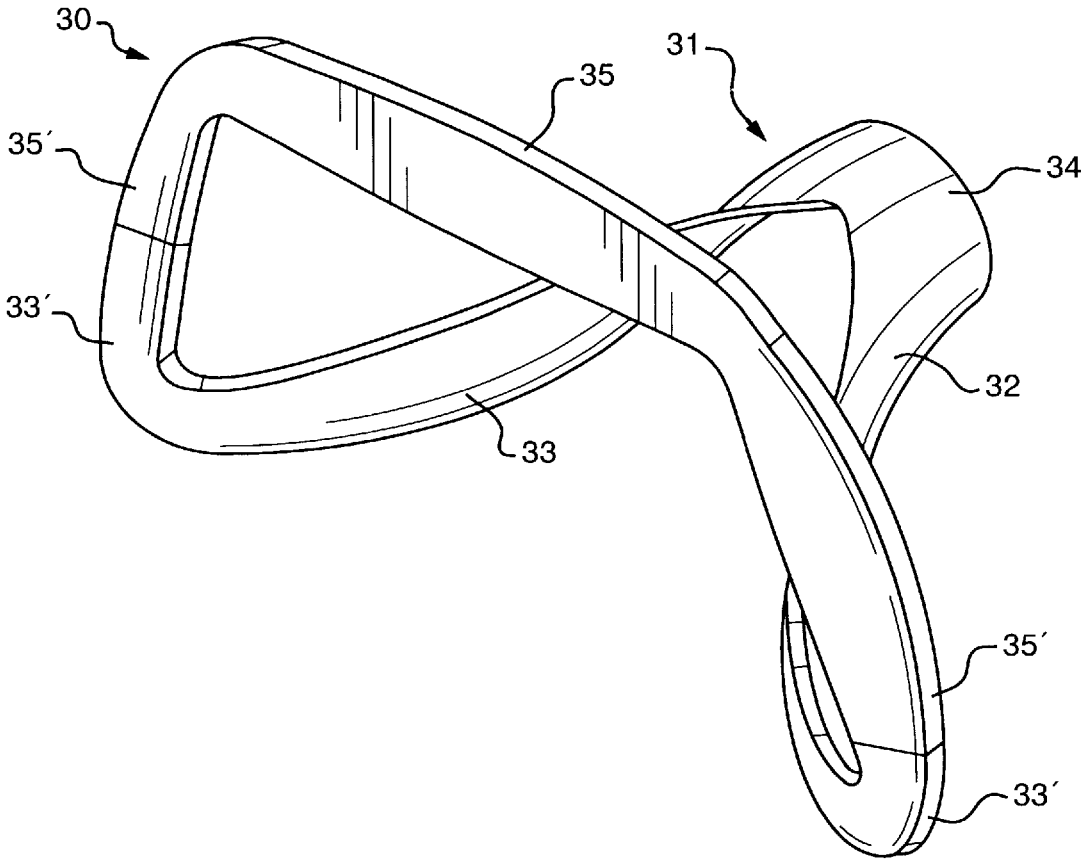
FIG. 3 is a perspective view showing a film-type saddle horizontal deflection member.
Figure 4:
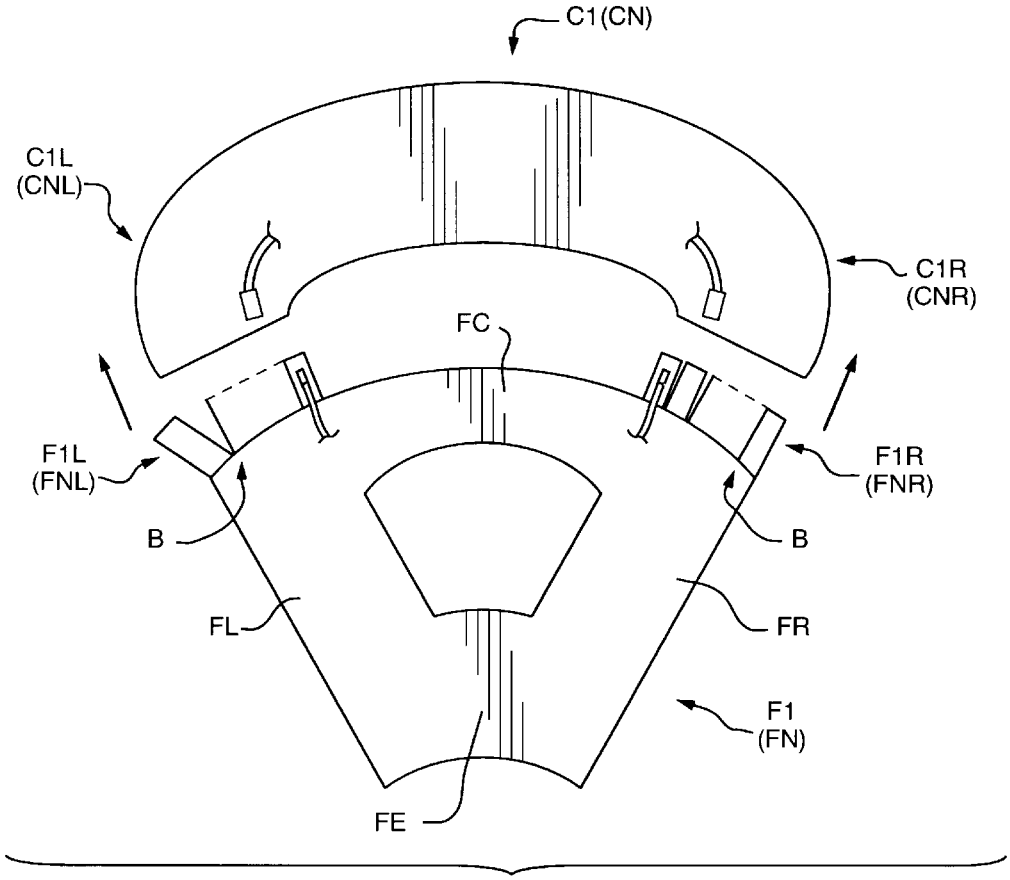
FIG. 4 is a perspective view showing a deflection film and a connection film constituting another film-type saddle horizontal deflection member.
Figure 5:
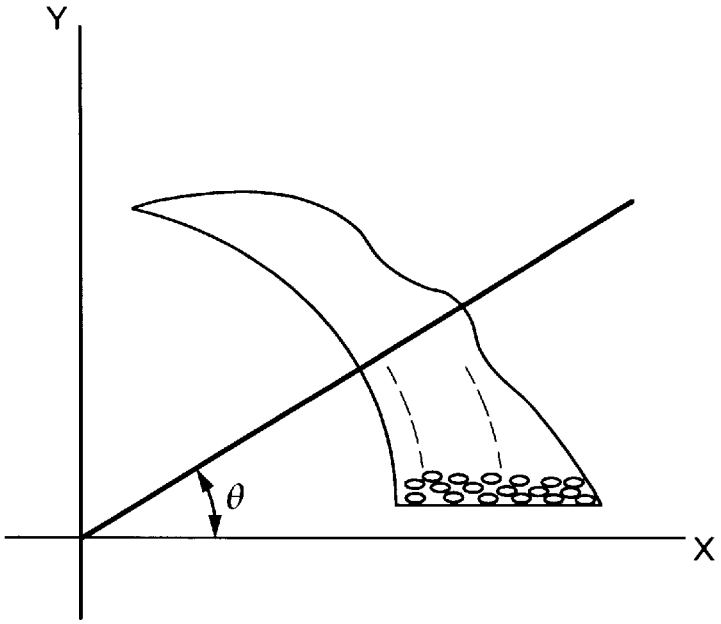
FIG. 5 is a sectional view taken at a right angle with respect to an axis of a tube for illustrating a distribution of a conventional saddle horizontal deflection coil.

FIG. 5 is a sectional view of film-type saddle horizontal deflection coils for a cathode ray tube taken at a right angle with respect to an axis of the tube for illustrating a distribution of the coils. In FIG. 5, various kinds of coil distributions, which are different from the distribution required to form a desired magnetic field, can be employed.

Figure 6:
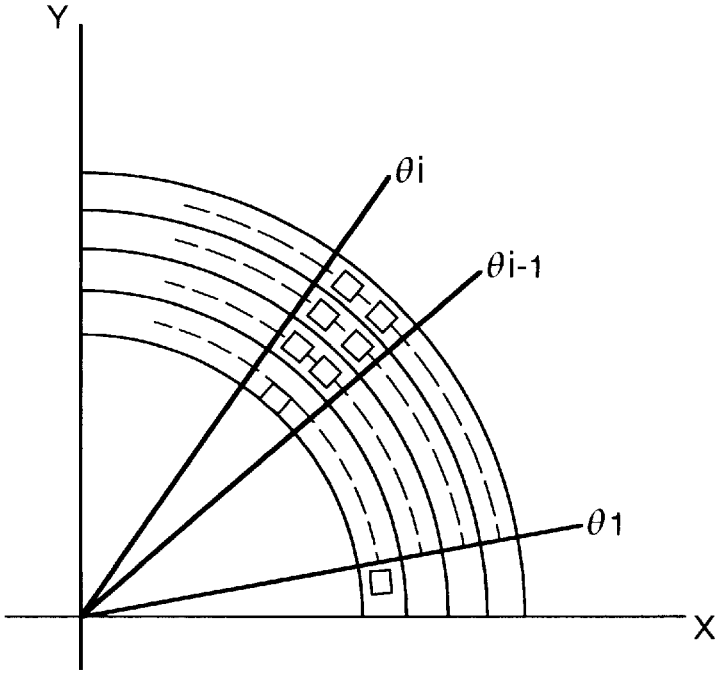
FIG. 6 is a sectional view taken at a right angle with respect to an axis of a tube for illustrating a method of arranging conductive wires in a film-type saddle horizontal deflection member according to the present invention.

FIG. 6 is a sectional view taken at a right angle with respect to the axis of the tube for illustrating a method of arranging a conductive wire pattern of a film-type saddle horizontal deflection member for a cathode ray tube according to the present invention.

Figure 7:
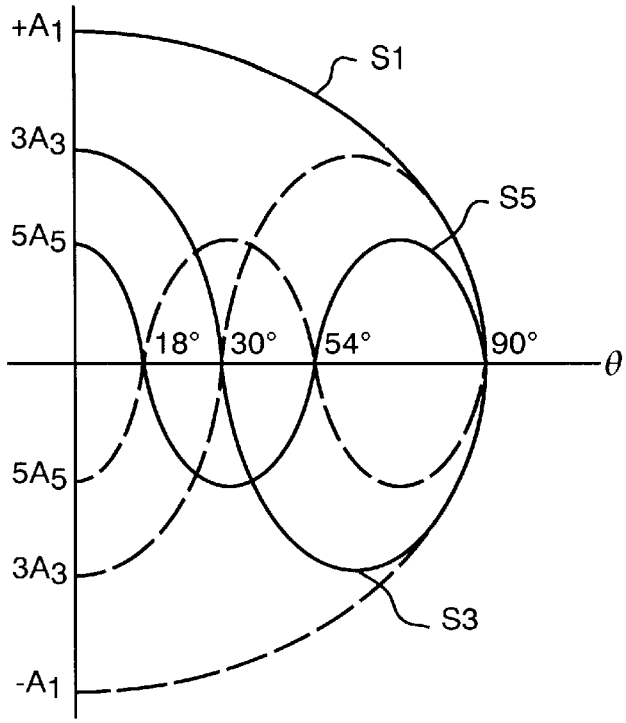
FIG. 7 is a Fourier series graph for illustrating a method of arranging conductive wires of a film-type saddle horizontal deflection member for a cathode ray tube according to the present invention.
Figure 8:
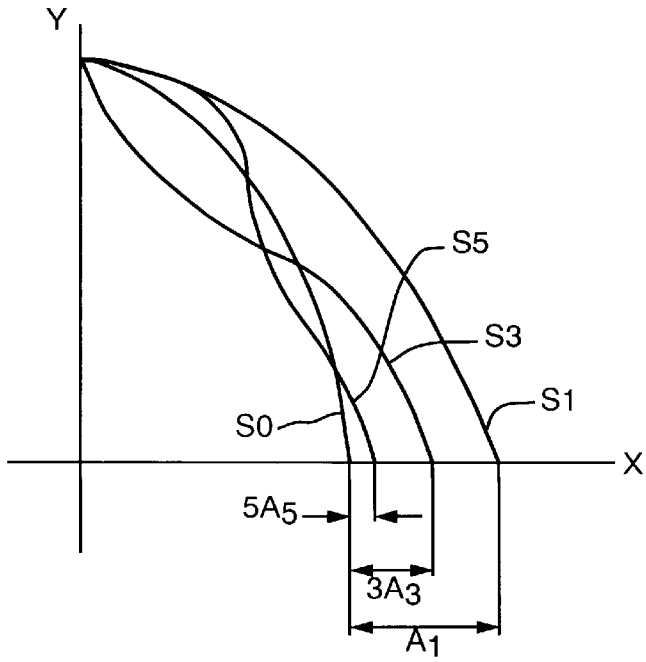
FIG. 8 is a graph for illustrating a method of arranging conductive wires, in which the Fourier series graph shown in FIG. 7 is applied to the film-type saddle horizontal deflection member for a cathode ray tube according to the present invention.

Firstly, according to the method of the present invention, in FIGS. 7 and 8, the total number of conductive wires, which are disposed from a horizontal axis of the cathode ray tube to a position having an angle of θ, is determined by the following equation of a Fourier series according to an angle θ taken from the horizontal axis of the tube: $[\Phi(\theta)=A_1 \sin \theta+A_3 \sin 3\theta+A_5 \sin 5\theta+\ldots]$, (wherein, θ is an angle taken from the horizontal axis to 90 degree, $A_1, A_3, A_5, \ldots, A_{2N-1}$ are integers, and n is a natural number), and the conductive wire distribution at the position of θ is determined by the following equation which is obtained by differentiating the Fourier series with respect to θ: $\phi(\theta)=A_1 \cos \theta+3A_3 \cos 3\theta+5A_5 \cos 5\theta+\ldots$, (wherein, θ is an angle taken from the horizontal axis to 90 degree, $A_1, A_3, A_5, \ldots, A_{2N-1}$ are integers, and n is a natural number). That is, FIGS. 7 and 8 show the distribution of the conductive wires according to the equation of $\phi(\theta)=A_1 \cos \theta+3A_3 \cos 3\theta+5A_5 \cos 5\theta+\ldots$ In FIGS. 7 and 8, a first order term to a third order term of the above Fourier series are illustrated by curved lines S1, S3, and S5. In addition, FIG. 8 shows the curved lines S1, S3, and S5 made by applying the first to third order terms of the Fourier series to the basis of a curved line S0 which is corresponding to a sectional shape of the neck or funnel of the tube. In the meantime, a coefficient ($A_1$) of the first order term is a number of basic conductive wires determining the deflection sensitivity, and since conductive wires are oppositely distributed upward and downward about 30 degree according to the second order term, the center of the magnetic field moves upward or downward according to signs (i.e, negative sign or positive sign) of a coefficient ($A_3$) of the second order term, so the coefficient ($A_3$) is a main component for producing the barrel magnetic field or the pin-cushion magnetic field. In addition, since conductive wires according to the third order term are distributed as a quadrupole form in a cartesian coordinate, the third order term may exert an influence on the convergence of the in-line type three electron beams.

Accordingly, by varying each coefficient of each order term in the Fourier series, it is possible to arrange the conductive wires and to determine the number of the conductive wires in such a manner that the optimum deflection sensitivity and the optimum convergence can be obtained.

Figure 9:
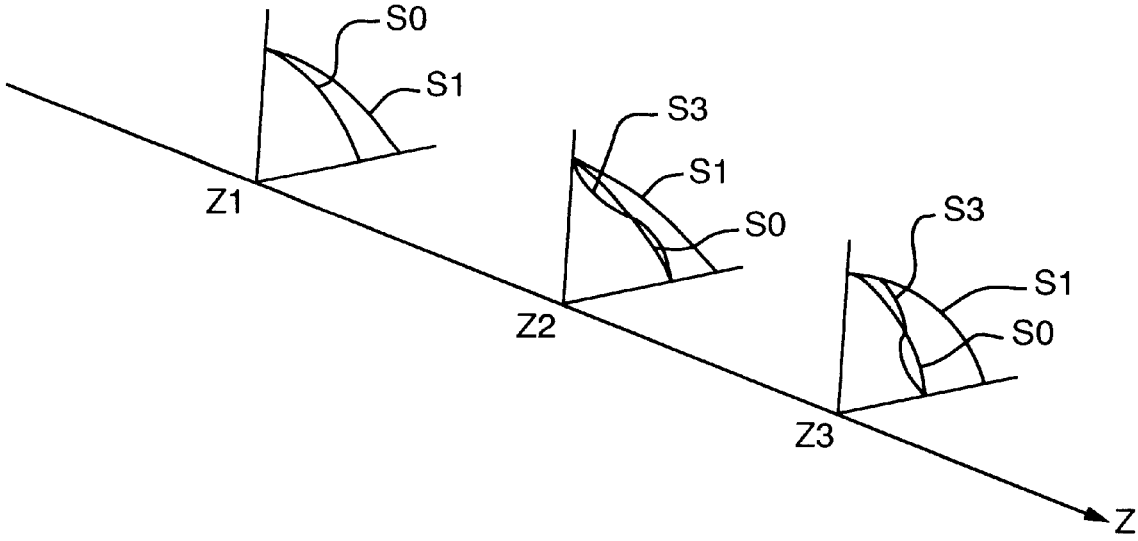
FIG. 9 is a graph for illustrating a method of arranging conductive wires in each sectional area which is vertically taken along an axis of a tube.

FIG. 9 is a graph for illustrating a method of arranging conductive wires in each sectional area Z1, Z2, Z3 . . . which is vertically disposed along the axis of the tube. By finding the coefficient value of the Fourier series at each sectional area Z1, Z2, Z3 according to the above mentioned method, the various distributions of conductive wires in each sectional area Z1, Z2, Z3 can be obtained.

Concretely, after finding the angles $\theta_i$ and $\theta_{i-1}$ in FIG. 6 in which the difference value between $\Phi(\theta_i)$ and $\Phi(\theta_{i-1})$ is corresponding to the number of films, one conductive wire is arranged in each film disposed between the angles $\theta_i$ and $\theta_{i-1}$. At this time, one conductive wire can be arranged at the central angle positioned between the angles $\theta_i$ and $\theta_{i-1}$, or alternatively, the conductive wire can be variously arranged within the range of the angles according to the characteristics of the tube.

In addition, in order to consider the influence of the thickness of each film on the electron beams, the conductive wires can be arranged by compensating the total number of conductive wires divided into each film with the following equation: $Ps=(R+s*P)^2/\Sigma(R+s*P)^2$ [wherein, R is a radius of a tube at a sectional area, s is a natural member defined from 1 to the total number n of the films, P is a pitch (thickness) of the film]. That is, the total number of the conductive wires of each film is determined by the following equation: $\Phi s(\theta)[=Ps*\Phi(\theta)=Ps*(A_1 \sin \theta+A_3 \sin 3\theta+A_5 \sin 5\theta+\ldots)]$, and one conductive wire is arranged in each film disposed between the angles $\theta_i$ and $\theta_{i-1}$ in which the difference value between $\Phi(\theta_i)$ and $\Phi(\theta_{i-1})$ is set to 1. At this time, by setting Ps to 1/n, it is also possible to equally divide the total conductive wires into each film regardless the influence of the magnetic field caused by the difference of distance from the axis of the tube.

In this manner, the conductive wires can be arranged in each sectional area positioned along the axis of the tube, and the film-type deflection member can be manufactured in a pattern structure in which the conductive wires are connected to each other in series. As a result, the present invention can obtain the film-type deflection member according to the Fourier series. That is, by dividing the angle θ into predetermined spaces according to the Fourier series and by substituting the $\theta_i$ and $\theta_{i-1}$ therefor, the desirable distribution of the conductive wires as shown in FIG. 6 can be obtained. In addition, after finding a coil distribution chart corresponding to a predetermined magnetic field pattern and obtaining a Fourier series similar to the coil distribution chart from experience, the conductive wires having the distribution and number according to the angle range $\theta_i$ and $\theta_{i-1}$ in the deflection member can be arranged. That is, the film-type deflection member can be manufactured to be nearly perfect as it is designed taking experiences into consideration.

As mentioned above, by converting a curved line of a predetermined magnetic field pattern into a Fourier series and arranging conductive wires of each film according to the Fourier series, the present invention can obtain an optimum deflection sensitivity and an optimum convergence, and thereby producing exactly the same magnetic field pattern as designed.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A method of arranging a conductive wire pattern of film-type saddle deflection member for a cathode ray tube, the film-type saddle deflection member having a plurality of conductive wires so as to produce a predetermined magnetic field as a current is applied to the conductive wires, the film-type saddle deflection member comprising a plurality of deflection films (F1(FN) and a plurality of connection films, the plurality of deflection films (F1(FN) being stacked one on another and formed in a predetermined shape, the plurality of deflection films (F1(FN) having a pair of deflection portions, a neck end turn portion, and a pair of first connection portions, the plurality of connection films having a pair of second connection portions and connecting the pair of first connection portions of the deflection films to each other at the pair of the second connection portions thereof, thereby forming a funnel end turn portion, wherein, the total number of conductive wires arranged from a horizontal axis of the cathode ray tube to a position having an angle of θ is determined by the following equation according to angle θ taken from the horizontal axis of the cathode ray tube: $[\Phi(\theta)=A_1 \sin \theta+A_3 \sin 3\theta+A_5 \sin 5\theta+\ldots]$, in which θ is an angle taken from the horizontal axis to 90 degrees, $A_1$, $A_3$, $A_5, \ldots, A_{2N-1}$ are integers, and n is a natural number.

2. The method of arranging a conductive wire pattern of a film-type saddle deflection member for a cathode ray tube as claimed in claim 1, wherein one conductive wire is arranged in each film disposed between angles $\theta_i$ and $\theta_{i-1}$ where a difference value between $\Phi(\theta_i)$ and $\Phi(\theta_{i-1})$ is corresponding to the number of films.

3. The method of arranging a conductive wire pattern of a film-type saddle deflection member for a cathode ray tube as claimed in claim 2, wherein one conductive wire is arranged in each film disposed at a central portion between angles $\theta_i$ and $\theta_{i-1}$ where a difference value between $\Phi(\theta_i)$ and $\Phi(\theta_{i-1})$ is corresponding to the number of films.

4. The method of arranging a conductive wire pattern of a film-type saddle deflection member for a cathode ray rube as claimed in claim 1, wherein the conductive wires are arranged by compensating the total number of the conductive wires divided into each film with the following equation: $Ps=(R+s*P)^2/\Sigma(R+s*P)^2$, in which R is a radius of a tube at a sectional area, s is a natural number defined from 1 to the number of the films, P is a pitch(thickness), and the total number of the conductive wires is determined by the following equation: $\Phi s(\theta)[=Ps*\Phi(\theta)=Ps*(A_1 \sin \theta+A_3 \sin 3\theta+A_5 \sin 5\theta+\ldots)]$, and one conductive wire is arranged in each film disposed between angles $\theta_i$ and $\theta_{i-1}$ in which a difference value between $\Phi(\theta_i)$ and $\Phi(\theta_{i-1})$ is set to 1.

5. The method of arranging a conductive wire pattern of a film-type saddle deflection member for a cathode ray tube as claimed in claim 4, wherein the Ps is set to 1/n.

6. A film-type saddle deflection member for a cathode ray tube having a plurality of conductive wires so as to produce a predetermined magnetic field as a current is applied to the conductive wires, the film-type saddle deflection member comprising:

a plurality of deflection films (F1(FN), which have a pair of deflection portions, a neck end turn portion, and a pair of first connection portions, said plurality of deflection films (F1(FN) being stacked one on another and formed in a predetermined shape; and a plurality of connection films having a pair of second connection portion, the plurality of connection films connecting the pair of first connection portions of the deflection films to each other at the pair of the second connection portions thereof, thereby forming a funnel end turn portion, wherein, the total number of conductive wires arranged from a horizontal axis of the cathode ray tube to a position having an angle of θ is determined by a following equation according to angle θ taken from the horizontal axis of the cathode ray tube: $[\Phi(\theta)=A_1 \sin \theta+A_3 \sin 3\theta+A_5 \sin 5\theta+\ldots]$, in which θ is an angle taken from the horizontal axis to 90 degree, $A_1$, $A_3$, $A_5, \ldots, A_{2N-1}$ are integers, and n is a natural number.

7. The film-type saddle deflection member for a cathode ray tube as claimed in claim 6, wherein one conductive wire is arranged in each film disposed between angles $\theta_i$ and $\theta_{i-1}$ where a difference value between $\Phi(\theta_i)$ and $\Phi(\theta_{i-1})$ is corresponding to the number of films.

8. The film-type saddle deflection member for a cathode ray tube as claimed in claim 6, wherein the conductive wires are arranged by compensating the total number of the conductive wires divided into each film with a following equation: Ps=(R+s*P)2/Σ(R+s*P)2, in which R is a radius of a tube at a sectional area, s is a natural number defined from 1 to the number of the films, P is a pitch(thickness), and the total number of the conductive wires is determined by the following equation: $\Phi s(\theta)[=Ps*\Phi(\theta)=Ps*(A_1 \sin \theta+A_3 \sin 3\theta+A_5 \sin 5\theta+ \ldots)]$, and one conductive wire is arranged in each film disposed between angles $\theta_i$ and $\theta_{i-1}$ in which a difference value between $\Phi(\theta_i)$ and $\Phi(\theta_{i-1})$ is set to 1.

9. The film-type saddle deflection member for a cathode ray tube as claimed in claim 8, wherein the Ps is set to 1/n.

* * * * *